US011478949B2

(12) United States Patent
Goodman

(10) Patent No.: US 11,478,949 B2
(45) Date of Patent: Oct. 25, 2022

(54) PIPE CUTTING APPARATUS AND METHODS FOR USE OF THE SAME

(71) Applicant: Reed Goodman, Midland, TX (US)

(72) Inventor: Reed Goodman, Midland, TX (US)

( * ) Notice: Subject to any disclaimer, the term of this patent is extended or adjusted under 35 U.S.C. 154(b) by 0 days.

(21) Appl. No.: 17/230,708

(22) Filed: Apr. 14, 2021

(65) Prior Publication Data

US 2021/0323188 A1 Oct. 21, 2021

Related U.S. Application Data

(60) Provisional application No. 63/011,628, filed on Apr. 17, 2020.

(51) Int. Cl.
*B26D 7/26* (2006.01)

(52) U.S. Cl.
CPC ..... *B26D 7/2614* (2013.01); *B26D 7/26* (2013.01)

(58) Field of Classification Search
CPC ..... B26D 3/16; B26D 7/0006; B26D 7/2614; B26D 7/26
See application file for complete search history.

(56) References Cited

U.S. PATENT DOCUMENTS 3,183,702 A * 5/1965 Zittell ..... B23D 21/14 72/370.01
4,864,726 A * 9/1989 Wu ..... H02G 1/1265 30/90.1
5,692,426 A * 12/1997 Alexander ..... B27G 5/02 269/295
6,267,037 B1 * 7/2001 McCoy, Jr. ..... B23D 57/0084 83/810
6,941,660 B1 * 9/2005 Varos ..... B23D 45/12 30/93
8,607,814 B1 * 12/2013 Boltjes ..... F16L 55/105 83/745
2006/0053998 A1 * 3/2006 Makkonen ..... B23D 55/02 83/745

* cited by examiner

*Primary Examiner* — Omar Flores Sanchez
(74) *Attorney, Agent, or Firm* — Seed Intellectual Property Law Group LLP

(57) ABSTRACT

A fixture includes a pipe having a vertical axis that is coaxial with a center of the pipe, a cutting element having a cutting blade, and a jig assembly coupled to the cutting element and arranged to orient the cutting blade at an angular orientation relative to the vertical axis of the pipe. Related methods and components are also provided.

14 Claims, 7 Drawing Sheets

PIPE CUTTING APPARATUS AND METHODS FOR USE OF THE SAME

BACKGROUND

Technical Field

The present disclosure is generally related to pipe cutting apparatuses and related fixtures or jigs.

Description of the Related Art

Pipes come in a wide variety of sizes and shapes. For certain applications, it is desirable to cut the pipes at a chamfer or angle. For example, building fences with recycled pipes where some pipes are vertically arranged to support additional pipes horizontally arranged between the vertically arranged pipes. Conventionally, such pipes are cut by a torch. Repeatedly cutting and matching the same chamfers on pipes, however, has proven to be problematic and often results in inconsistent shapes.

BRIEF SUMMARY

Various implementations and embodiments of a fixture described herein provide compact, efficient, and robust form factors for repeatedly and consistently cutting pipes at angles. For example, in one embodiment, a fixture can be summarized as including a pipe having a vertical axis that is coaxial with a center of the pipe, a cutting element having a cutting blade, and a jig assembly coupled to the cutting element and arranged to orient the cutting blade at an angular orientation relative to the vertical axis of the pipe.

For example, in another embodiment, a jig assembly for coupleably receiving a cutting element to angularly cut a pipe can be summarized as including a frame structure, the frame structure having a first side frame and a second side frame, the first side frame having a first receiving region and the second side frame having a second receiving region, the first and second receiving regions sized and shaped to receive the cutting element; and a collar assembly having a fixed collar and an adjustable collar, the fixed collar fixedly coupled to the frame structure and the adjustable collar adjustably coupleable to the pipe.

For example, in another embodiment, a method can be summarized as including coupling a cutting element to a jig assembly; coupling the jig assembly to a pipe; laterally moving the jig assembly in a first direction to make a first angular cut of the pipe; and laterally moving the jig assembly in a second direction to make a second angular cut of the pipe.

DETAILED DESCRIPTION

Figure 1:
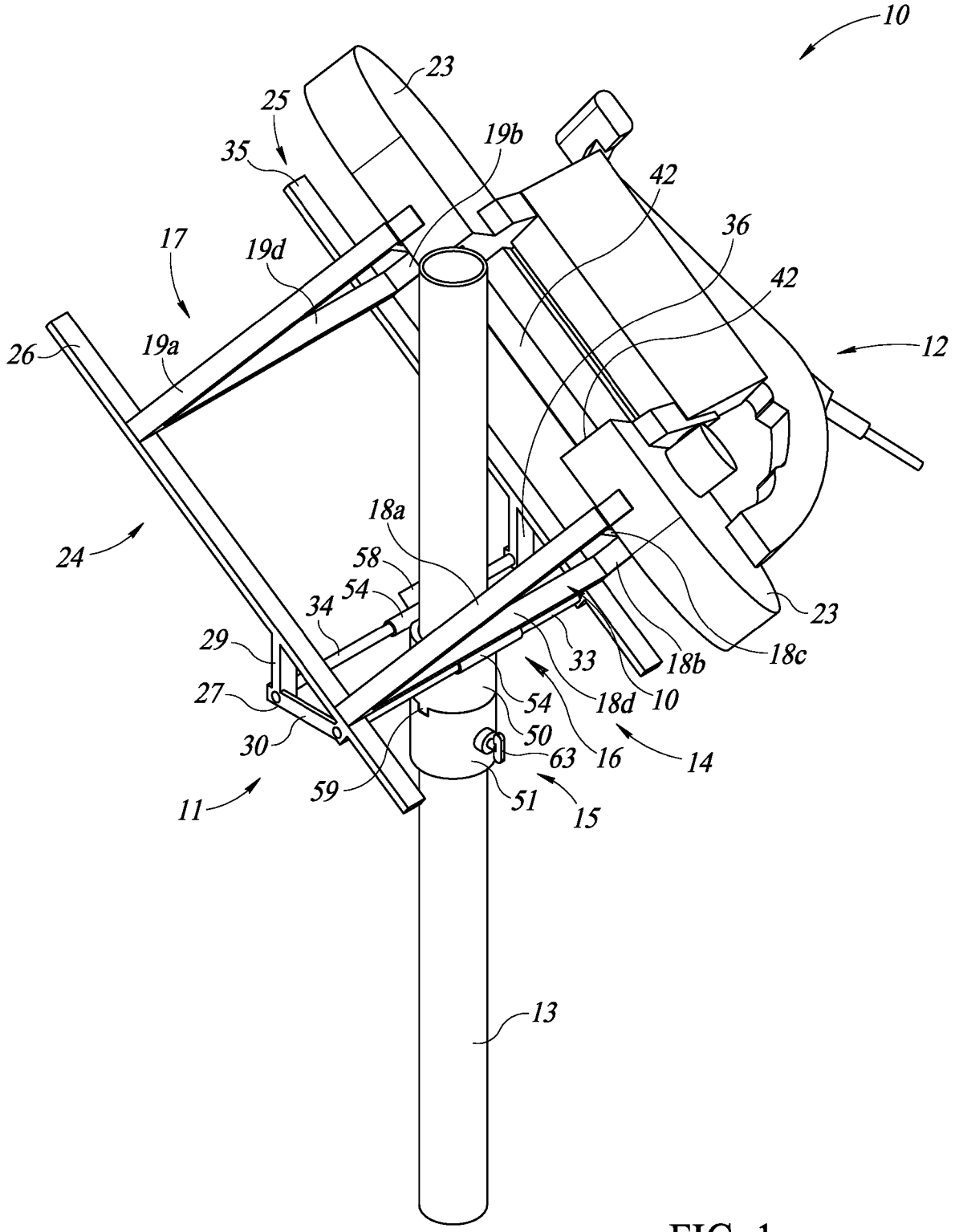
FIG. 1 is an isometric view of a fixture, according to one example, non-limiting embodiment.

In the following description, certain specific details are set forth in order to provide a thorough understanding of various disclosed embodiments. One skilled in the relevant art will recognize that embodiments may be practiced without one or more of these specific details. In other instances, well-known structures and devices associated with pipes, jigs, fixtures, and related apparatuses, components, devices, assemblies, and methods may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

FIGS. 1-7 illustrate a fixture 10 according to one example, non-limiting embodiment. The fixture 10 includes a jig assembly 11, a cutting element 12, e.g., a band saw, and a pipe 13 received in the jig assembly 11. As explained in more detail herein, the jig assembly 11 is sized, shaped, and generally configured to provide repeatability in cutting chamfers on pipes.

The jig assembly 11 includes a frame structure 14 and a collar assembly 15. The frame structure 11 includes a first side frame 16 and a second side frame 17. The first side frame 16 has a generally trapezoidal structure and shape and comprises a plurality of first side bars 18*a*, 18*b*, 18*c*, and 18*d*. The second side frame 17 is generally similar to the first side frame 16 and has a generally trapezoidal structure and shape constructed by a plurality of second side bars 19*a*, 19*b*, 19*c*, and 19*d*. The first side bars 18*a* and 18*b* extend outwardly beyond the first side bar 18*c* to provide a first receiving region 20. Similarly, the second side bars 19*a* and 19*b* extend outwardly beyond the second side bar 19*c* to provide a second receiving region 21. The first and second receiving regions 20, 21 are sized and shaped to coupleably receive the cutting element 12. For example, as illustrated in FIGS. 1-7, side portions 23 of the cutting element 12, e.g., band saw, are received in the first and second receiving regions 20, 21. Portions of the first side bars 18*a*, 18*b* and second side bars 19*a*, 19*b* abut the side portions 23 of the cutting element 11. In some embodiments, portions of the first side bars 18*a*, 18*b* and second side bars 19*a*, 19*b* that abut side portions 23 may include one or more fastener apertures. The fastener apertures are sized and shaped to receive fasteners to couple to the side portions 23 of the cutting element 12.

The frame structure 14 also includes a pair of angle frames, specifically, first angle frame 24 and second angle frame 25. The first angle frame 24 includes a first bar element 26 and an L-bracket 27. The first bar element 26 is oriented angularly with respect to the first side frame 16 and a central vertical axis 28 of the fixture 10. The central vertical axis 28, in some embodiments, may be substantially coaxial with a center of the pipe 13. For example, as illustrated in detail in FIG. 5, the first bar element 26 extends at an angle $\alpha_1$ with respect to the central vertical axis 28. The angle $\alpha_1$ can vary between 5 and 70 degrees, and is generally selected to be less than 90 degrees. The L-bracket 27 includes a first flange 29 and a second flange 30. The first flange 29 extends substantially parallel to the central vertical axis 28 and the second flange 30 extends substantially perpendicular to the central vertical axis 28. The first bar element 26 couples to the first and second side frames 16, 17, with the first side frame 16 spaced apart from the second side frame 17.

The second angle frame 25 includes a second bar element 35 and a flange element 36. The second bar element 35 is generally oriented to be parallel with the first bar element 26. In particular, the second bar element 35 is oriented angularly with respect to the second side frame 17 and the central vertical axis 28 of the fixture 10. For example, as illustrated in detail in FIG. 6, the second bar element 35 extends at an angle $\alpha_2$ with respect to the central vertical axis 28. Again, the angle $\alpha_2$ can vary between 5 and 70 degrees, and is generally selected to be less than 90 degrees. The flange element 36 extends substantially parallel to the central vertical axis 28. The second angle frame 25 includes an opening 37 adjacent to the flange element 36.

The second bar element 35 includes a tab element 38 having a first access aperture 39. The flange element 36 also includes a second access aperture 40. The first and second access apertures 39, 40 are sized and shaped to coupleably receive respectively the first and second rod elements 33, 34. In particular, the first and second access apertures 39, 40 coupleably receive the respective first and second rod elements 33, 34 which slideably are moveable therethrough. Thus, as the cutting element 12 cuts through the pipe 13, the first and second rod elements 33, 34 slideably move through the first and second access apertures 39, 40.

Figure 2:
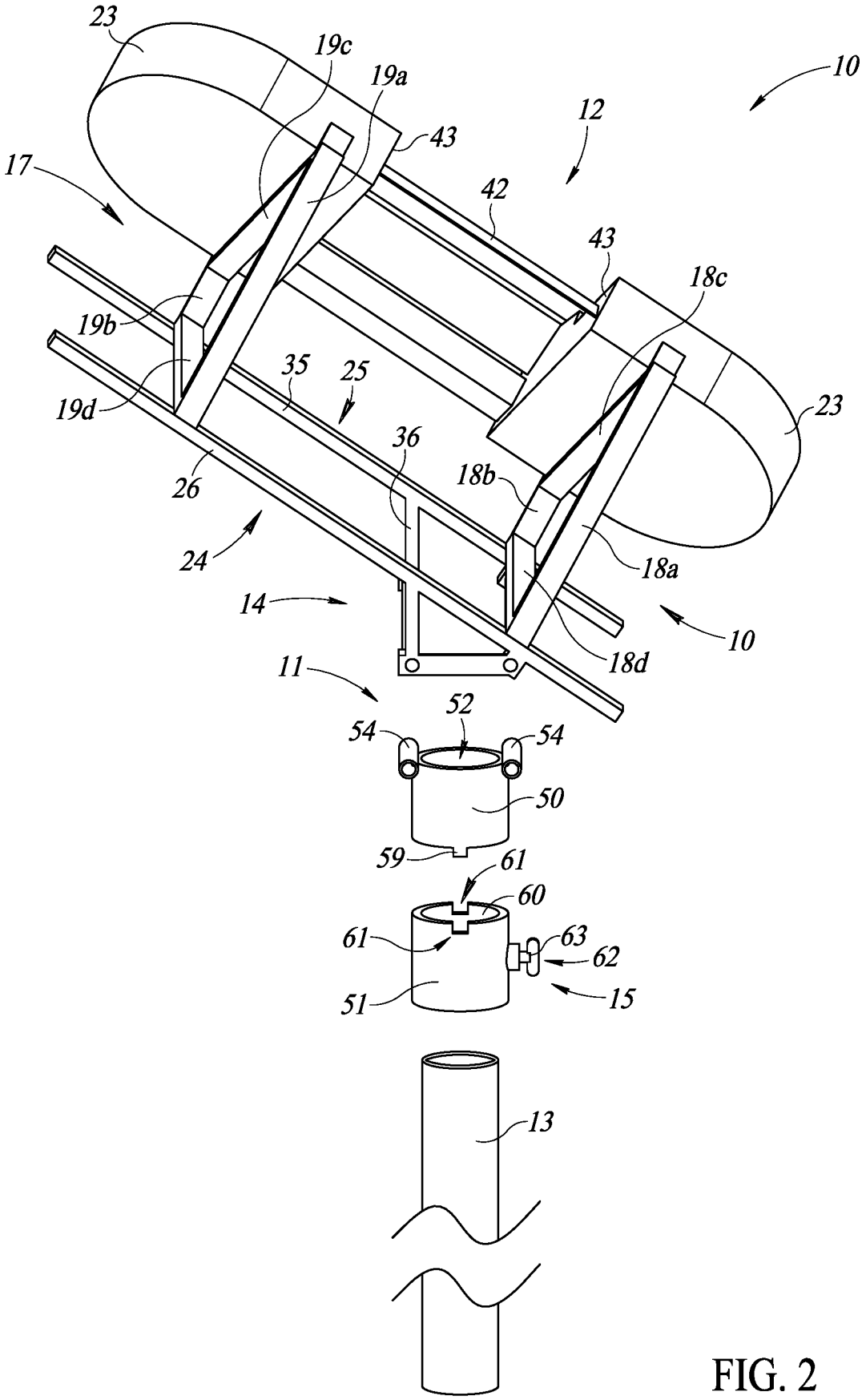
FIG. 2 is an exploded view of the fixture of FIG. 1.
Figure 3:
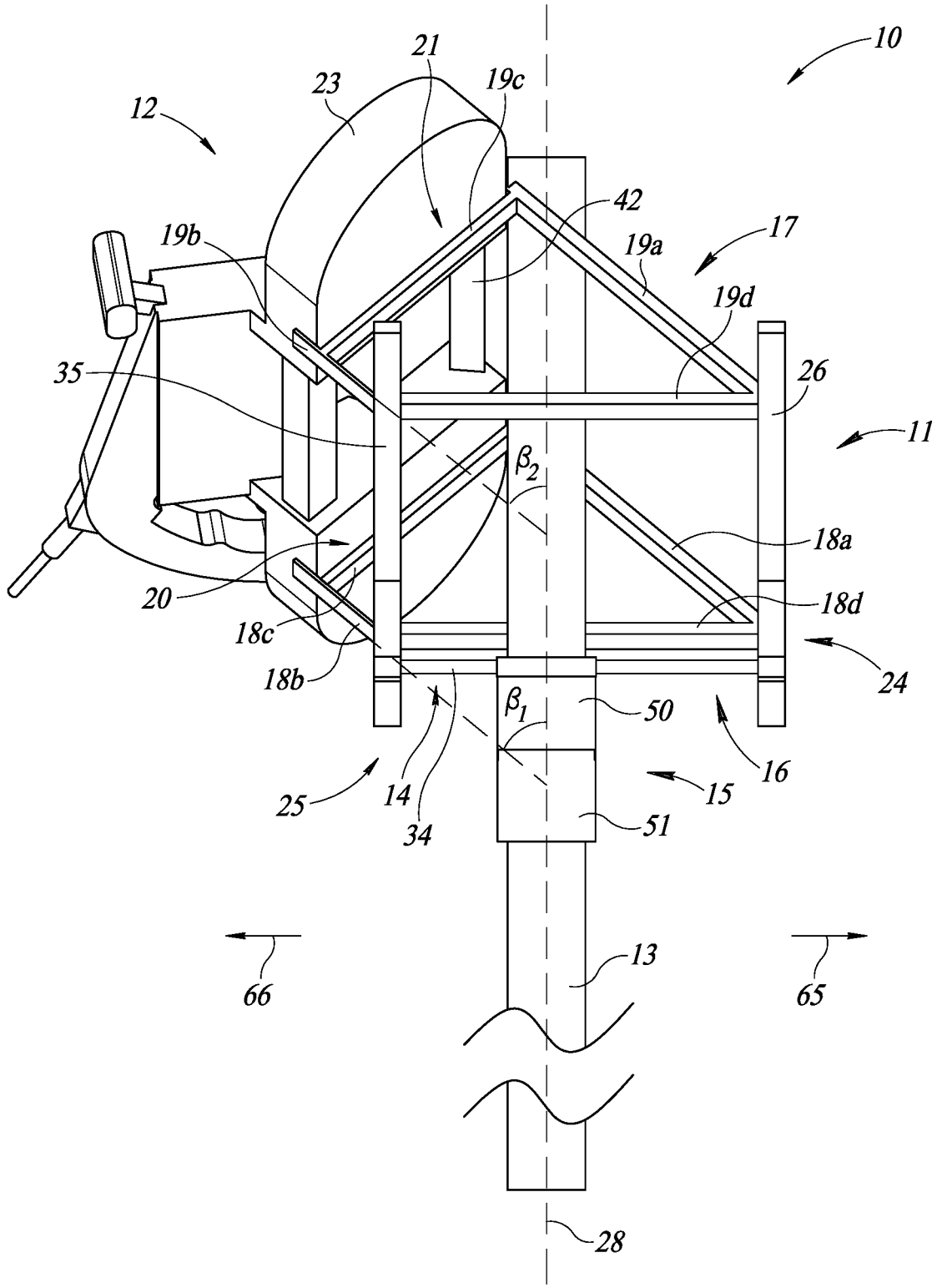
FIG. 3 is a left side view of the fixture of FIG. 1.
Figure 4:
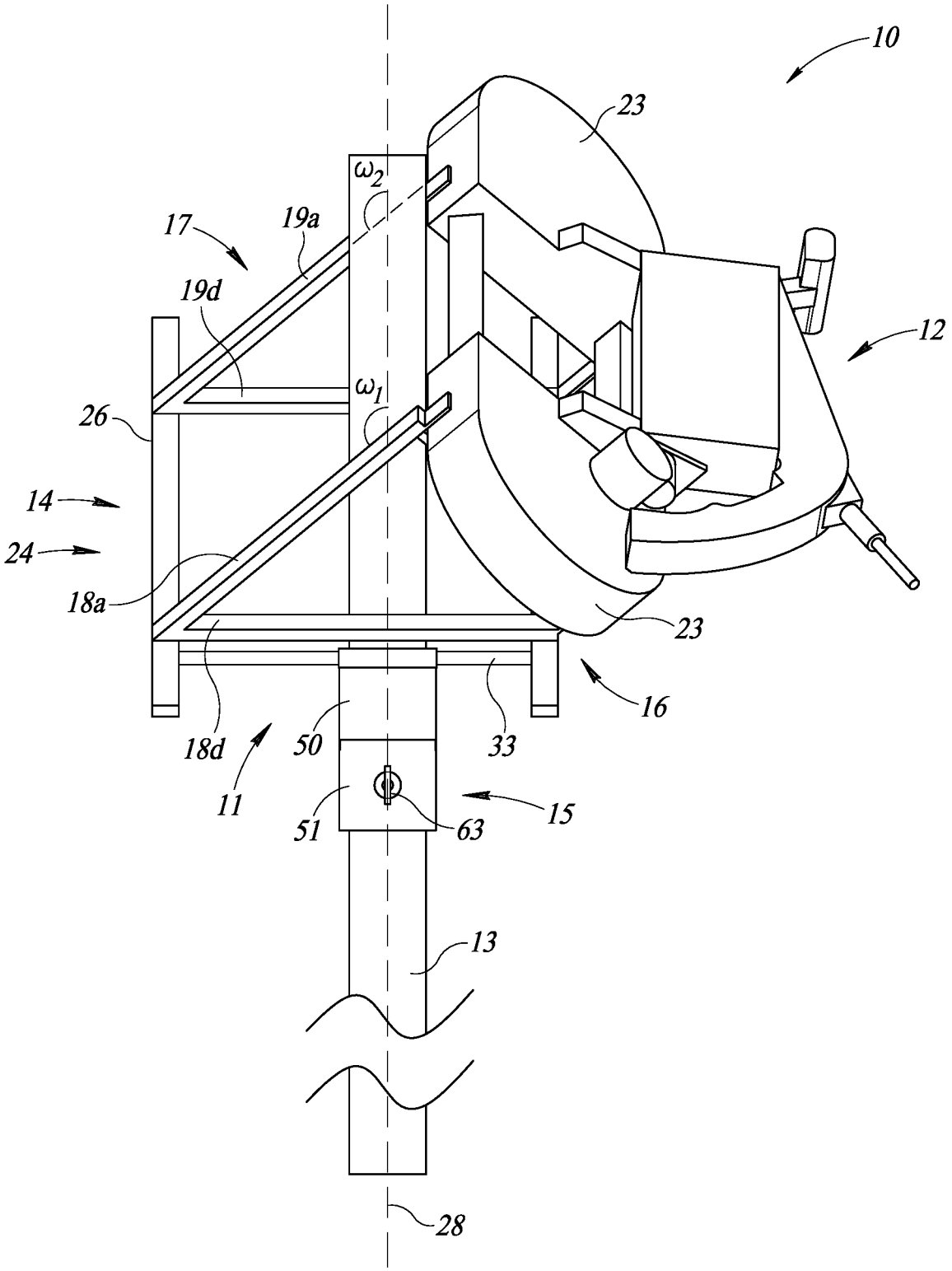
FIG. 4 is a front side view of the fixture of FIG. 1.

The jig assembly 11, as described above, is generally configured to cut the pipe 13 at angles. For example, as described above, the first bar element 26 extends at an angle $\alpha_1$ with respect to the central vertical axis 28 and the second bar element 35 extends at an angle $\alpha_2$ with respect to the central vertical axis 28. As illustrated in FIG. 3, the first side bar 18*b* is oriented at an angle $\beta_1$ with respect to the central vertical axis 28 and the second side bar 19*b* is oriented at an angle $\beta_2$ with respect to the central vertical axis 28. As illustrated in FIG. 4, the first side bar 18*a* is oriented at an angle $\omega_1$ with respect to the central vertical axis 28 and the second side bar 19*a* is oriented at an angle $\omega_2$ with respect to the central vertical axis 28. Thus, when the cutting element 12 is received by the jig assembly 11, the cutting element 12 is oriented angularly. Moreover, in some embodiments, the cutting element 12 includes a cutting blade 42 that can be oriented angularly. For example, as illustrated in FIG. 2, the cutting blade is oriented angularly with respect to side edges 43 of the side portions 23 of the cutting element 12. Thus, as the cutting element 12 is operated, the cutting blade 42 cuts the pipe 13 at an angle, as represented by the dashed line 44 in FIG. 5.

Moreover, in some embodiments, the jig assembly 11 may be tiltable and/or rotatable to adjust the angular orientation of the cutting element 12 with respect to the pipe 13. For example, in some embodiments, the first side frame 16 and the second side frame 17 may include a tilt and/or rotation mechanism to tilt or rotate the cutting element 12 to adjust the angular orientation. Such mechanism may comprise rotary bearings, adjustment screws, slider-crank mechanisms, gears, or any combination thereof. In some embodiments, such mechanism may be positioned or coupled to the first side bar 18*b* and second side bar 19*b*. In some embodiments, the interface or connection between the first side bar 18*b* and first side bar 18*d* and the second side bar 19*b* and the second side bar 19*d* may take the form of the tilt and/or rotary mechanism.

As described above, the jig assembly 11 includes a collar assembly 15. In particular, the collar assembly 15 includes a fixed collar 50 and an adjustable collar 51. The fixed collar 50 is generally hollow, having a first pipe aperture 52. The first pipe aperture 52 is sized and shaped to receive therein the pipe 13. The fixed collar 50 includes a pair of spaced apart coupling members 54. The coupling members 54 are generally hollow and are sized, shaped, and arranged to receive therethrough the respective first and second rod elements 33, 34. The fixed collar 50 is fixedly coupled to the frame structure 14. For example, in some embodiments, as shown in FIG. 1, the fixed collar 50 may be fixedly coupled to the frame structure 14 via a plate element 58 that is coupled to the first side bar 18*a*. In this manner, movement of the frame structure 14 allows the fixed collar 50 to move therewith. At or near an end, the fixed collar 50 includes a pair of tab elements 59. The tab elements 59 are sized, shaped, and arranged to couple to the adjustable collar 51.

In particular, the adjustable collar 51 is generally hollow, having a second pipe aperture 60. Again, the second pipe aperture 60 is sized and shaped to receive therein the pipe 13. The adjustable collar 51 includes a pair of recesses 61. The pair of recesses 61 are sized, shaped, and arranged to coupleably receive the tab elements 59. Extending from an outer surface, the adjustable collar 51 includes an adjustment mechanism 62. The adjustment mechanism 62 is generally configured to secure the adjustable collar 51 to the pipe 13. For example, as illustrated in FIGS. 1-7, the adjustment mechanism 62 includes a fastener element 63. The fastener element 63 is generally sized and shaped to adjustably secure the adjustable collar 51 to the pipe.

In operation, a user may insert the adjustable collar 51 over the pipe 13. Upon selecting an appropriate height or axial position with respect to the height of the pipe 13, the user may secure the adjustable collar 51 by operating the adjustment mechanism 62. Thereafter, the frame structure 14 can be secured to the pipe 13. In particular, as described above, the fixed collar 50 is fixedly coupled to the frame structure 14. Thus, with the pipe 13 received through the first pipe aperture 52, as the frame structure 14 is moved toward the adjustable collar 51, the tab elements 59 mate with and are received in the recesses 61 to couple to the adjustable collar 51. In some embodiments, the cutting element 12 may be secured to the frame structure 14 prior to coupling to the adjustment collar 51. In some embodiments, the cutting element 12 may be secured to the adjustable frame structure 14 post-coupling to the adjustment collar 51. As described above, in some embodiments, the frame structure 14 may be moved by tilting and/or rotating to adjust the cutting angle. Upon selecting an angular orientation of the frame structure 14, and thereby the cutting element 12, the frame structure 14 may be locked in place, for example, by tightening the adjustment screw, or by other locking mechanisms.

Figure 5:
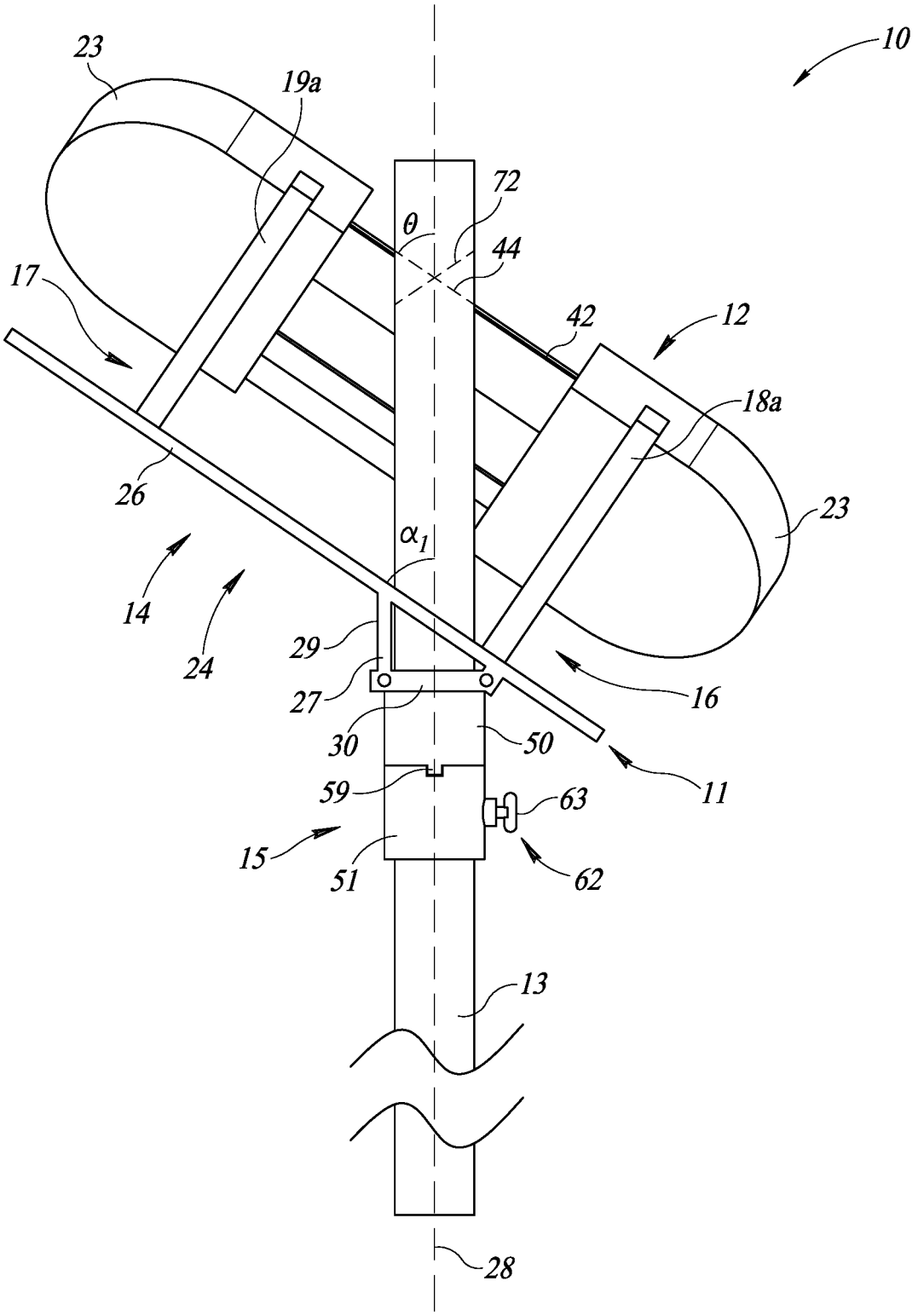
FIG. 5 is a right side view of the fixture of FIG. 1.
Figure 6:
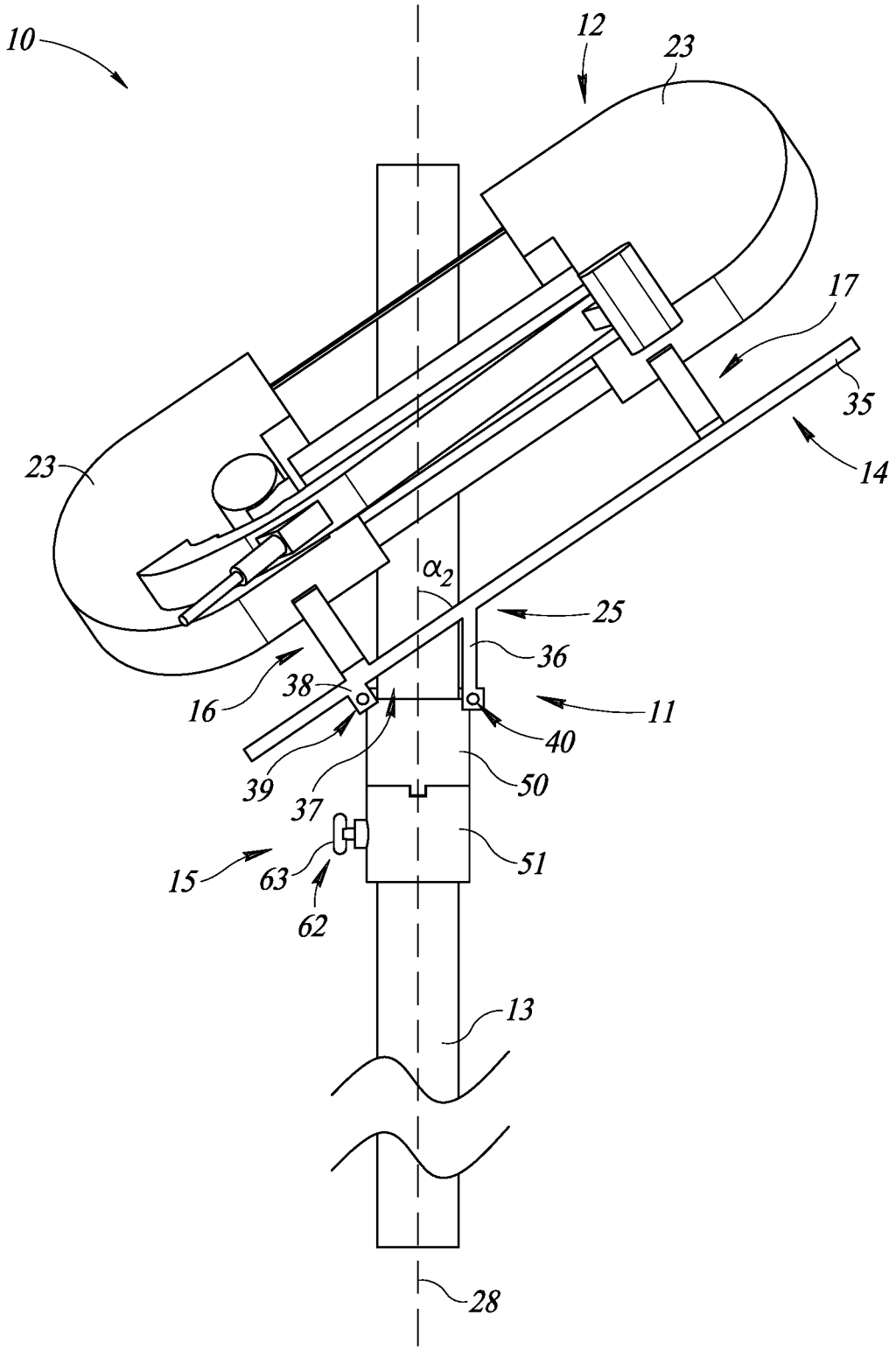
FIG. 6 is a back view of the fixture of FIG. 1.
Figure 7:
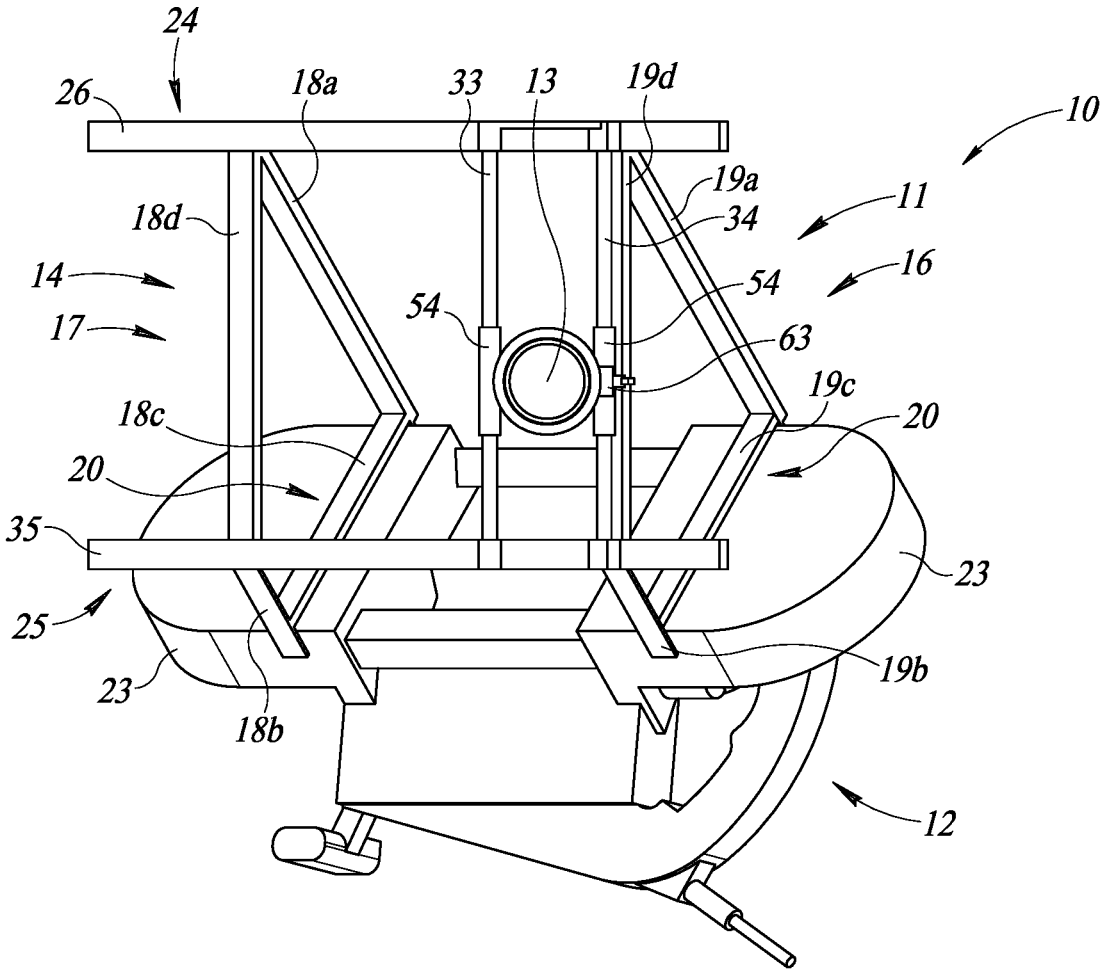
FIG. 7 is a bottom view of the fixture of FIG. 1.

The user may thereafter operate the cutting element 12 and move it laterally in direction 65 to cut the pipe 13 along the cut line 44, illustrated in FIG. 5. Upon cutting the pipe 13, the fixed collar 50 may be unsecured and/or uncoupled from the adjustable collar 51. For example, the frame structure 14 may be vertically or axially moved with respect to the pipe 13 to uncouple and/or unsecure the fixed collar 50. Upon uncoupling, the frame structure 14 may be moved laterally in an opposite direction to lateral direction 65, for example, as indicated by direction 66, via slideable movement of the first and second rod elements 33, 34. Thereafter, the frame structure 14 may be rotated 180 degrees to cut the other side of the pipe 13. In particular, the frame structure 14 may be moved vertically or axially with respect to the pipe 13 to secure and/or couple the fixed collar 50 to the adjustable collar 51. Thereafter, the cutting element 12 may be operated and moved laterally via the frame structure 14 laterally in direction 66 to cut the pipe 13 along cut line 72. As the angular orientation of the cutting element 12 is fixed by the angular orientation of the frame structure 14, the angular cuts, e.g., as illustrated cut lines 44, 72, are substantially symmetric. In addition, such symmetric angular cuts are advantageously repeatable in additional pipes due to the fixed orientation of the frame structure 14.

Moreover, the various embodiments described above can be combined to provide further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A fixture for cutting a pipe having a vertical axis that is coaxial with a center of the pipe, the fixture comprising:
- a cutting element having a cutting blade; and
- a jig assembly including a frame structure, the frame structure having a first side frame and a second side frame, the first side frame having a plurality of first side bars that are arranged to define a first receiving region, the second side frame having a plurality of side bars that are arranged to define a second receiving region, the first and second receiving regions sized and shaped to receive the cutting element and arranged to orient the cutting blade at an angular orientation relative to the vertical axis of the pipe, wherein the frame structure further includes:
  - a first bracket coupled to the first side frame;
  - a second bracket coupled to the second side frame; and
  - a pair of rod elements fixedly coupled to the first side frame and slideably coupled to the second bracket; and
- a collar assembly having a fixed collar, the fixed collar fixedly coupled to the frame structure and including a pair of coupling elements sized and shaped to slideably receive the rod elements.

2. The fixture of claim 1 wherein the jig assembly is moveable in a lateral direction relative to the vertical axis, movement of the jig assembly cutting the pipe at a first angle relative to the vertical axis of the pipe.

3. The fixture of claim 2 wherein the rod elements are slideably moveable to laterally move the cutting element.

4. The fixture of claim 1 wherein the jig assembly includes an adjustable collar, the adjustable collar moveable in an axial orientation that is parallel to the vertical axis and sized and shaped to secure to the pipe at a selected height.

5. The fixture of claim 1 wherein the collar assembly includes an adjustable collar which is adjustably coupled to the pipe.

6. The fixture of claim 1 wherein the frame structure includes a first horizontal bar that is coupled to the first side frame and oriented angularly relative to the vertical axis of the pipe, and a second horizontal bar that is coupled to the first side frame and is oriented to be parallel to the first horizontal bar.

7. A jig assembly for coupleably receiving a cutting element to angularly cut a pipe, the jig assembly comprising:
- a frame structure, the frame structure having a first side frame and a second side frame, the first side frame having a first receiving region and the second side frame having a second receiving region, the first and second receiving regions sized and shaped to receive the cutting element;
- a pair of rod elements; and
- a collar assembly having a fixed collar and an adjustable collar, the fixed collar fixedly coupled to the frame structure and moveable therewith, the fixed collar including a pair of coupling elements sized and shaped to slideably receive, respectively, the pair of rod elements, the pair of rod elements configured to slideably move the frame structure via the pair of coupling elements, and the adjustable collar adjustably coupleable to the pipe.

8. The jig assembly of claim 7 wherein the first side frame and the second side frame are sized, shaped, and arranged to angularly orient the cutting element with respect to a central vertical axis of the pipe.

9. The jig assembly of claim 7 wherein the first side frame includes a plurality of first side bars that are arranged to define the first receiving region, and the second side frame includes a plurality of side bars that are arranged to define the second receiving region.

10. The jig assembly of claim 7 wherein the frame structure includes:
- a first bracket coupled to the first side frame;
- a second bracket coupled to the second side frame; and
- a pair of rod elements fixedly coupled to the first side frame and slideably coupled to the second bracket.

11. The jig assembly of claim 7 wherein the frame structure includes a first horizontal bar that is coupled to the first side frame and positioned to orient the cutting element angularly relative to a vertical axis of the pipe, and a second horizontal bar that is coupled to the first side frame and positioned to orient the cutting element angularly relative to the vertical axis of the pipe.

12. A method, comprising:
- coupling a cutting element to a jig assembly;
- coupling the jig assembly to a pipe having a central vertical axis, the coupling including:
  - fixedly coupling a fixed collar to a frame structure of the jig assembly, the fixed collar having a pair of coupling elements;
  - adjustably coupling an adjustable collar to the pipe;
  - coupling a pair of rod elements to the frame structure;
- laterally moving the jig assembly in a first direction to make a first angular cut of the pipe, the laterally moving including slideably moving the pair of rod elements through the coupling elements in the first direction; and
- laterally moving the jig assembly in a second direction to make a second angular cut of the pipe, the laterally moving slideably moving the pair of rod elements through the coupling elements in the second direction.

13. The method of claim 12, wherein coupling the jig assembly to the pipe includes:
- axially moving an adjustable collar in a direction that is parallel to the central vertical axis to secure the adjustable collar to the pipe at a selected height; and
- removably coupling a fixed collar coupled to the jig assembly to the adjustable collar.

14. The method of claim 13, comprising:

after making the first angular cut of the pipe, vertically moving the jig assembly to uncouple the fixed collar from the adjustable collar;

rotating the jig assembly 180 degrees; and vertically moving the jig assembly to couple the fixed collar to the adjustable collar.

* * * * *